United States Patent [19]

Alfano

[11] Patent Number: 4,659,921

[45] Date of Patent: Apr. 21, 1987

[54] ULTRAFAST GATED LIGHT DETECTOR

[76] Inventor: Robert R. Alfano, 3777 Independence Ave., Bronx, N.Y. 10463

[21] Appl. No.: 585,242

[22] Filed: Mar. 1, 1984

[51] Int. Cl.[4] ..... H01J 31/50

[52] U.S. Cl. ..... 250/213 VT; 313/528; 313/533

[58] Field of Search ..... 250/213 VT, 207, 213 R; 313/528, 529, 530, 532, 533, 537, 103 R

[56] References Cited

U.S. PATENT DOCUMENTS 3,885,178 5/1975 Goehner ..... 250/213 VT 4,467,189 8/1984 Tsuchiya ..... 250/213 VT

*Primary Examiner*—Edward P. Westin

*Attorney, Agent, or Firm*—Irving M. Kriegsman

[57] ABSTRACT

A light detector which can be gated on and off over an ultrashort time window, such as in picoseconds or femtoseconds, is disclosed. The light detector includes, in one embodiment, an input slit for receiving a light signal, relay optics, a sweep generator and a tubular housing, the tubular housing having therein a photocathode, an accelerating mesh, a pair of sweeping electrodes, a microchannel plate, a variable aperture and a dynode chain. Light received at the input slit is imaged by the relay optics onto the photocathode. Electrons emitted by the photocathode are conducted by the accelerating mesh to the sweeping electrodes where they are swept transversely across the tubular housing at a rate defined by the sweep generator over an angular distance defined by the sweeping electrodes, in a similar manner as in a streak camera. Swept electrons strike the microchannel plate where electron multiplication is accomplished. Exiting electrons which pass through the variable aperture and which strike the first dynode (cathode) in the dynode chain are further multiplied and outputted from the last dynode anode in the dynode chain as an analog electrical signal, the analog electrical signal corresponding to the intensity of the light signal during the time window over which swept electrons are picked up by the first dynode. In another embodiment of the invention all of the dynodes in the chain except for the last dynode are replaced by a second microchannel plate.

15 Claims, 3 Drawing Figures

ULTRAFAST GATED LIGHT DETECTOR

BACKGROUND OF THE INVENTION

The present invention relates to light detectors and more particularly to a light detector having an ultrafast gated input.

There is a need for a light detector having an input that can be gated on and off over an ultrashort time window, such as in picoseconds. For example, it is well known that Raman scattering signals produced when a sample is excited by a light source respond instantaneously following the shape of the impinging light signal, which may be a pulse on the order of picoseconds, while the fluorescence emission times are generally greater than a few nanoseconds. In order to measure the intensity of the Raman signals it would therefore be desirable to provide a light detector that can be gated on and off for a time period that is not longer than the excitation pulse.

Photomultiplier tubes are well known in the art and commonly used as light detectors to measure the intensity of light inpinging thereon. These tubes generally include a photocathode which receives a light signal and produces emission of electrons in proportion to the intensity of the impinging light and some form of electron multiplication means, such as a dynode chain for amplifying the emitted electrons.

Streak cameras are short about ten years old in the art and have been used, hitherto, to directly measure the time dynamics of luminous events, that is to time resolve a light signal. A typical streak camera includes an entrance slit which is usually rectangular, a streak camera tube, input relay optics for imaging the entrance slit onto the streak camera tube, appropriate sweep generating electronics and output-relay optics for imaging the streak image formed at the output end of the streak camera tube onto an external focal plane. The image at the external focal plane is then either photographed by a conventional still camera or a television camera. The streak camera tube generally includes a photocathode screen, an accelerating mesh, sweeping electrodes and an phosphor screen. The streak camera tube may also include a microchannel plate. Light incident on the entrance of the streak camera is converted into a streak image which is formed on the phosphor screen with the intensity of the streak image from the start of the streak to the end of the streak corresponding to the intensity of the light incident thereon during the time window of the streak. The time during which the electrons are swept to form the streak image is controlled by a sweep generator which supplies a very fast sweep signal to the sweeping electrodes. The input optics of the streak camera, in the past, has been a single lens.

In an article entitled "An Ultrafast Streak Camera System" by N. H. Schiller, Y. Tsuchiya, E. Inuzuka, Y. Suzuki, K. Kinoshita, K. Kamiya, H. Iida and R. Alfano appearing in the June, 1980, Edition of Optical Sprectra, various known streak camera systems are discussed. The article is incorporated herein by reference.

In U.S. Pat. No. 4,232,333 to T. Hiruma et al there is disclosed a streak image analyzing device in which the output streak image of a streak camera is fed into a television camera. The output of the television camera is fed through a videomixing circuit to a monitor. The output of the television camera is also fed to an integrating circuit through a gate circuit. The output of the integrating circuit is fed to a memory through an analog to digital converter. The output of the memory is displayed by a display unit and/or fed back into the videomixing circuit.

In an article entitled Picosecond Characteristics Of A Spectrograph Measured By A Streak Camera/Video Readout System by N. H. Schiller and R. R. Alfano appearing in the December 1980, issue of Optical Communications, Volume 35, No. 3. pp. 451–454, a streak camera/video readout system is disclosed.

Another article pertaining to streak cameras and spectrographs is Coupling An Ultraviolet Spectrograph To A Scloma For three Dimensional Picosecond Fluorescent Measurements by C. W. Robinson et al in Multichannel Image Detectors pp. 199–213 ACS Symposium Series 102, Amercian Chemical Society.

Known patents of interest include U.S. Pat. No. 2,823,577 to R. C. Machler; U.S. Pat. No. 3,385,160 to J. B. Dawson et al; U.S. Pat. No. 2,436,104 to A. W. Fisher et al; U. S. Pat. No. 3,765,769 to E. B. Treacy; U. S. Pat. No. 4,060,327 to Jacobowitz et al; U. S. Pat. No. 4,162,851 to A. Wade; U. S. Pat. No. 4,299,488 to W. J. Tomlinson and U.S. Pat. No. 4,320,971 to N. Hashimato et al.

It is the general purpose of this invention to provide a light detector having an ultrafast input gate.

Accordingly, it is an object of this invention to provide a new and improved light detector.

It is another object of this invention to provide a light detector having an input that can be gated on and off.

It is still another object of this invention to provide a light detector having an input that can be gated on and off in picoseconds.

It is yet still another object of this invention to provide a light detector which utilizes sweeping electronic such as found in a streak camera as a mechanism for gating on and off a light detector.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

SUMMARY OF THE INVENTION

A light detector constructed according to the teachings of the present ivnention comprises a photocathode for receiving a light signal and producing emission of electrons in proportion to the intensity of the light signal, an accelerating mesh for conducting the electrons emitted by the photocathode into a deflection field, sweeping electronic means for sweeping the electrons in the deflection field over a defined angular distance at a defined rate, electron multiplication means for receiving the electrons swept over at least a portion of the defined angular distance, performing electron multiplication thereon and producing an analog electric signal output, whereby the analog electrical signal output of the electron multiplication means will correspond to the intensity of the light incident on the photocathode over a time window corresponding to the time during which the electrons are received by the electron multiplication means.

In order that the invention may be more fully understood, it will now be described, by way of example, with reference to the accompanying drawing in which like reference numerals or characters represent like parts:

BRIEF DESCRIPTION OF THE DRAWINGS

In the drawings wherein like reference numerals represent like parts.

DETAILED DESCRIPTION OF THE PREFERRED EMBODIMENTS

The present invention is directed to a light detector which can be gated on and off over an ultrashort time window, such as in picoseconds or femtoseconds.

The present invention accomplishes this by providing a light detector which, in essence, combines into a single device parts of a streak camera and parts of a photomultiplier tube, with the streak portion of the device being used not to time resolve a light signal spatially as in the past but rather to gate the light signal over a very short time window.

Figure 1:
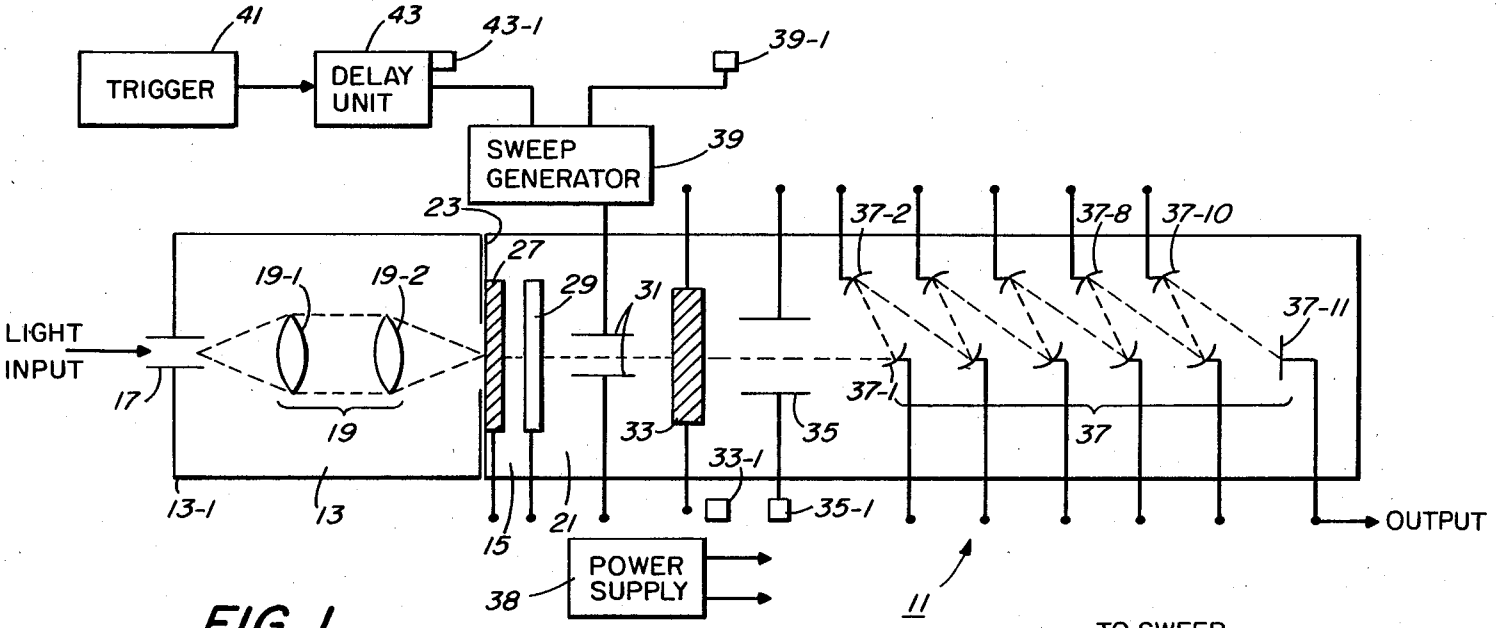
FIG. 1 is a diagram of a light detector constructed according to the teachings of the present invention.

Referring now to the drawings, there is illustrated in FIG. 1 a diagram of a light detector constructed according to the teachings of the present invention and identified generally by reference numeral 11.

Light detector 11 includes an input section 13 and a tube 15, tube 15, which will hereinafter be described, being basically a modified streak camera tube. Input section 13 images light incident thereon into the input end of tube 15. Tube 15 receives the light incident thereon and produces an analog electrical signal whose intensity is proportional to the intensity of the incident light over an ultrashort time window as will hereinafter be explained.

Input section 13 includes an input slit 17 and a relay lens system 19, the lens sytem 19 being made up of a first lens 19-1 at the focal distance from input slit 17, and a second lens 19-2 at the focal distance to a photocathode in tube 15, hereinafter is described. Input slit 17 is preferably rectangular in cross section but may be a pinhole or any other shape which produces the equivalent of a point source.

Tube 15 comprises a tubular housing 21 having an input end 23 and an output end 25. Disposed in housing 21 going from input end 23 to output end 25 are a photocathode 27, and accelerating mesh 29, a pair of sweeping electrodes 31, a microchannel plate 33, a variable aperture 35 and a dynode chain 37, the dynode chain 37 comprising a first dynode or cathode 37-1 a plurality of intermediate dynodes 37-2 through 37-10 and a last dynode or anode 37-11. Light detector 11 also includes a power supply 38 for providing operating power to the appropriate elements. Input section 13 may be housed in a separate tubular housing 13-1, as shown, or may be housed in the front of housing 21. Power supply 38 is connected to each dynode 37-1 thorugh 37-10 through a conventional resistive and capacitive circuit (not shown) used for the dynode chain in a photomultiplier tube so that each dynode will be negatively biased.

As can be appreciated, tube 15 is basically the equivalent of streak camera tube of the type having a microchannel plate in which the phosphor screen at the output end of the tube is replaced by a dynode chain and a variable aperture is provided between the micro channel plate and the dynode chain.

Microchannel plate 33 may be of the type used in Hamamatsu TV Co Ltd, Hamamatsu, Japan, streak camera tube model No. N895. The voltage applied to microchannel plate is controlled by a switch 33-1.

In the operation of light detector 11, light received at input slit 17 is collected by relay lens system 19 and brought to focus on photocathode 27. First lens 19-1 is at a distance from input slit 17 equal to its local length and second lens 19-2 is at a distance from photocathode 27 equal to its focal length.

Light striking photocathode 27 produces emission of electrons in proportion to the intensity of light incident thereon. The electrons so emitted are accellerated into tube 15 by accelerating mesh 29 and electrostatically swept transversely across tube 15 over a predetermined angular distance at a predetermined velocity (rate) by sweeping electrodes 31. The sweep generator 39 which is connected to sweeping electrodes 31. The particular signal supplied by sweep generator 39 (i.e. the particular speed of one complete sweep) is controlled by a switch 39-1. Variable sweep generator 39 receives a trigger signal from a trigger 41, such as a pin diode, which is coupled to sweep generator 39 through a variable delay unit 43. Delay unit 43 delays the time of arrival the trigger signal to sweep generator 39. The swept electrons strike microchannel plate 33 producing electron multiplication through secondary emission. At least some of the electrons emitted by microchannel plate 33 and passing through vairable aperture 35 strike first dynode 37-1 in dynode chain 37. The electrons which actually pass through variable aperture 35 depend on the size of the opening in variable aperture and the electrons passed through which actually strike first dynode 37-1 depend on the size and position of first dynode 37-1. Electrons striking first dynode (i.e. cathode) 37-1 are deflected successively through intermediate dynode 37-2 through 37-10 to last dynode (i.e. anode) 37-11 during which additional electron multiplication is produced and are outputted as an analog electrical signal from last dynode 37-11.

As can be appreciated, the streak portion of tube 15, namely, accellerating mesh 29 and sweeping electrodes 31, causes electrons emitted from photocathode 27 to be swept over a predetermined angular distance is dependent mainly on the space between the two seeping electrodes 31 and the distance from sweeping electrodes to microchannel plate 33 and the sweep generator 39. The sweep rate and angular distance, together, define a time window produced by the streak portion of tube 15 over which the incident light signal is gated, the time window being equal to the time of one complete sweep. For example, if sweep generator 39 causes electrons to be swept at a rate of 25 picoseconds per millimeter and the defined angular distance of a complete sweep is 15 millimeters then the time window or gate produced by the streak portion of tube 15 for one complete sweep is 375 picoseconds.

The ultimate time window or gate of detector 11 is also dependent on and may be further limited by the size of dynode 37-1 and the openign of variable aperture 35.

If dynode 37-1 is sized to intercept all of the electrons emitted from microchannel plate 33, then all electrons emitted therefrom will impinge thereon. However, if dynode 37-1 is sized to intercept only a portion of the electrons emitted from microchannel plate 33, then the resulting time gate for detector 11 will be proportionally reduced.

Variable aperture 35 is made of electrical shielding material and controls the portion of the electrons emitted from microchannel plate 33 that strike first dynode 37-1. The size of the opening of variable aperture 35 is controlled by a knob 35-1. For example, if dynode 37-1 is sized to receive all electrons emitted from microchannel plate 33 and variable aperture is adjusted so that only one-quarter of the electrons so emitted will strike dynode 37-1 then the overall time window or gate produced by detector 11 will be one-quarter of the time during which a complete sweept is made.

As can thus be appreciated, the time window is initially determined by the time over which a single sweep is made but may be further fractionalized or reduced by providing a first dynode that is sized to intercept only a portion of the electrons emitted by microchannel plate 33 and/or by reducing the opening of aperture 35.

Sweep generator 39 may be of the type used in Hamamatsu TV Co. Ltd, Hamamatsu, Japan, streak camera Model No. C1370 which provides sweep speeds for a single complete sweep of 375 picoseconds, 1000 picoseconds, 2000 picoseconds, 5000 picoseconds and 1 nanosecond.

Thus, a time window on the order of as small as 375 picoseconds may be produced and by selecting the size of first dynode 37-1 and/or adjusting the size of opening of variable aperture 35, the time window may be reduced by a factor on the order of around ten or greater.

In the absence of a sweep signal, the accelerated electrons passed between sweeping electrodes 31 and striking microchannel plate 33 will not strike first dynode 37-1.

Delay unit 43 delays the arrival of the trigger signal to sweep generator 39. Delay unit may provide step delays such as 30, 50, 100, 200 and 500 picoseconds and, as such, effectively shift the time window temporally by any one of these amounts or may of a type which provides continuous delays and/or may be programmable.

As can be appreciated, time windows or gates on the order of around 30 picoseconds of an incident light signal may be produced, with the size of the time window being limited only by the jitter caused by the sweep generators.

Light detector 11 amy be enclosed by a main housing (not shown).

Figure 2:
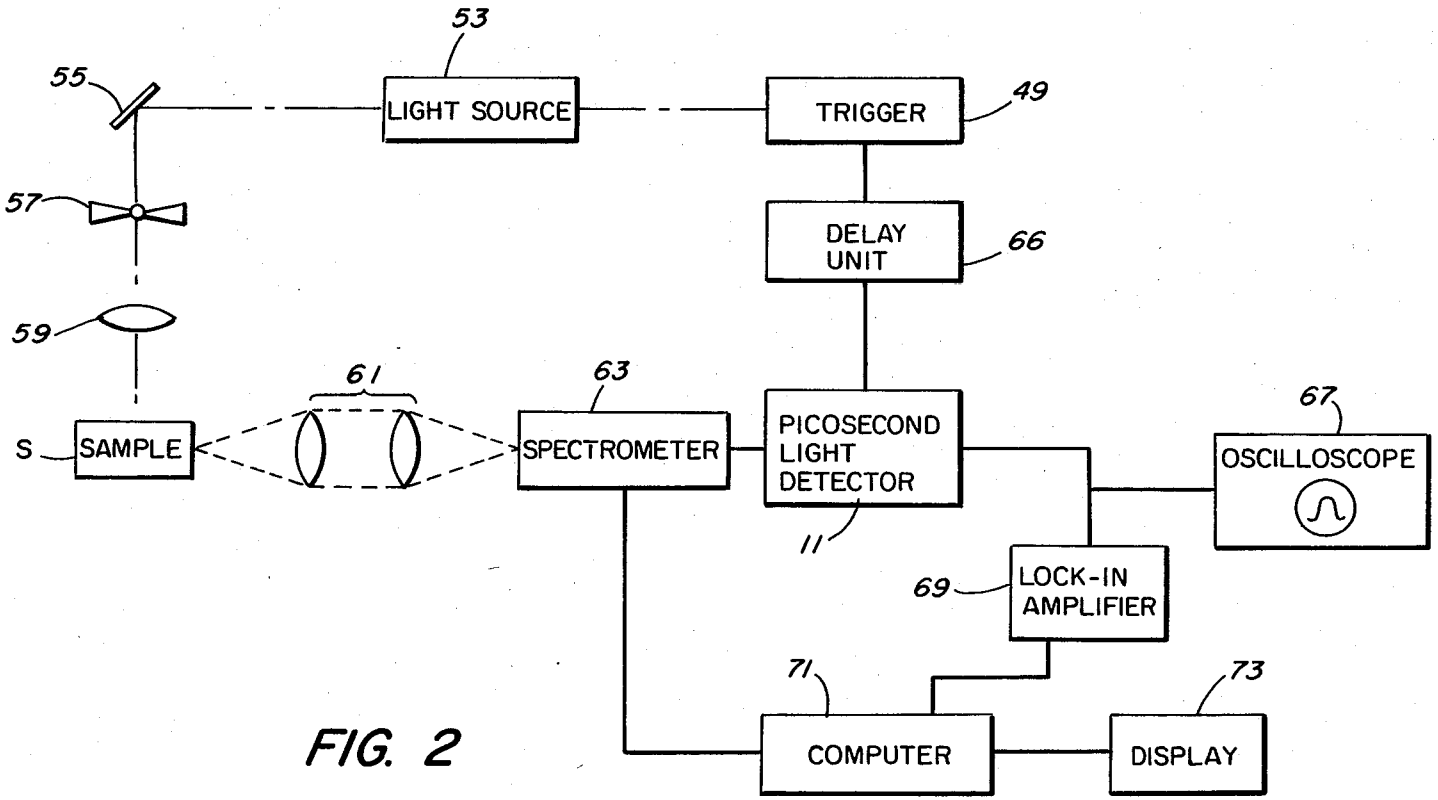
FIG. 2 is a diagram of an optical system including the light detector in FIG. 1.

Referring now to FIG. 2, there is illustrated a diagram of a system 51 using picosecond light detector 11.

Light from a laser light source 53 which may be a train of picosecond pulses from a mode locked continuous wave laser or a single pulse mode locked laser is deflected by a mirror 55, passed through a chopper 57 and brought to focus by a lens 59 on a sample S to be tested. Light outputed from sample S is collected and brought to focus by a relay lens system 61 at the input of a spectrometer 62. Light from the spectral region of interest from spectrometer 63 is passed into light detector 11 which measures the intensity of the light over a time window set by streak camera 13. Light from laser 53 is also used to provide a light signal for triggering trigger 49 which may be a photodiode. The trigger signal from trigger 49 is fed ito the sweep generator in streak camera 13 of light detector 11 through delay unit 66 which may be the same as delay unit 47. Alternatively, delay unit 55 may be programmable and controlled by the computer hereinafter described over a line (not shown). The analog electrical output signal from light detector 11 is fed through a lock-in amplifier 69 to a computer 71 where it may be stored and/or displayed on a monitor 73. Computer 71 is also coupled to spectrometer 63 for controlling the spectral region of interest that is outputted from spectrometer 63 to picosecond light detector 11. If light source 53 is a single shot or a low repetition rate laser, chopper 57 is eliminated.

Figure 3:
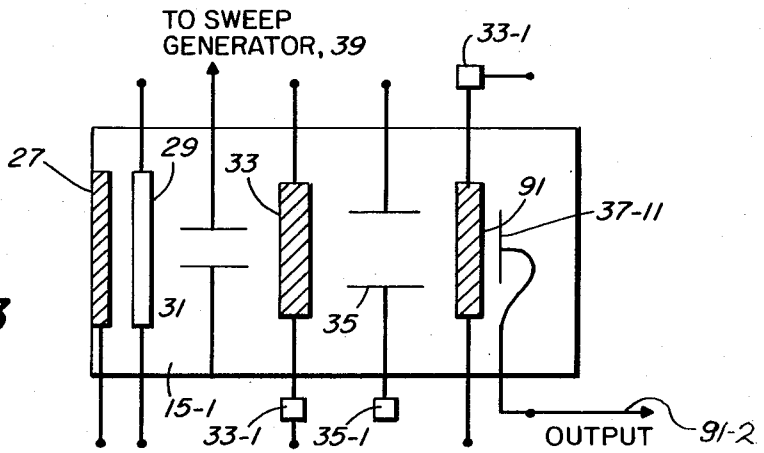
FIG. 3 is a diagram of another embodiment of the light detector of the present invention.

In FIG. 3 there is illustrated a modified version of the tube portion of the invention. In the FIG. 3 version, dynodes 37-1 through 37-10 are replaced by a second microchannel plate 91 and the tube identified by reference numeral 15-1. The FIG. 3 embodiment operates in a similar manner as the FIG. 1 embodiment with the difference being that electrons outputted from microchannel plate 33 are apertured by aperture 35, passed and further amplified by a second microchannel plate 91 rather than a chain of dynodes. The anode (dynode 37-11) collects the swept electron beam passing through aperture 35 and outputs a signal 91-2.

The embodiments of the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A gated light detector comprising a housing having therein:

a. a photocathode for receiving a light signal and producing emission of electrons in proportion to the intensity of the light signal, b. an accelerating mesh for accelerating the electrons emitted by the photocathode into a deflection field, c. sweeping electronic means for sweeping the electrons in the deflection field over a defined angular distance at a defined rate, d. a first microchannel plate for performing electron multiplication on at least some of the swept electrons, e. electron multiplication means comprising a dynode chain for performing electron multipication on at least some of the electrons emitted from said first microchannel plate, f. variable aperture means for limiting the electrons passed from the first microchannel plate to the electron multiplication means, and g. anode means for receiving electrons from the dynode chain and producing an analog electrical signal output.

2. A gated light detector comprising a housing having therein:

a. a photocathode for receiving a light signal and producing emission of electrons in proportion to the intensity of the light signal, b. an accelerating mesh for accelerating the electrons emitted by the photocathode into a deflection field, c. sweeping electronic means for sweeping the electrons, in the deflection field over a defined angular distance at a defined rate, d. a first microchannel plate for performing electron multiplication on at least some of the swept electrons, e. a second microchannel plate for performing electron multiplication on at least ome of the electrons passed through the first microchannel plate, f. variable aperture means for limiting the electrons passed from the first microchannel plate to the second microchannel plate, and g. anode means for receiving electrons from the second microchannel plate and producing an analog electrical signal output.

3. A gated light detector comprising:

a. a photocathode for receiving a light signal and producing emission of electrons in proportion to the intensity of the light signal;

b. an accelerating mesh for accelerating the electrons emitted by the photocathode into a deflection field;

c. sweeping electronic means for sweeping the electrons in the deflection field over a defined angular distance at a defined rate;

d. electron multiplication means for receiving the electrons swept over at least a portion fo the defined angular distance, performing electron multiplication thereon and producing an analog electric signal output corresponding to the intensity of the light incident on the photochathode over a time window corresponding to the time during which the electrons are received by the electron multiplication means;

e. said time window being dependent on the sweep rate of the sweeping electronic means and the size of the electron multiplication means relative to the defined angular distance;

f. a variable aperture disposed behind and spearate from said sweeping electronic means and in front of said electron multiplication means for limiting the angular distance over which electrons swept by the sweeping electronic means are received by the electron multiplication means so as to further reduce the time window;

g. said sweeping electronic means comprising a pair of sweeping electrodes and a sweep generator, said sweep generator being activated by a trigger signal;

h. said electron multiplication means comprising a microchannel plate and an electron collecting anode; and i. a second microchannel plate disposed between the variable aperture and the sweeping electrodes.

4. The gated light detector of claim 3 and wherein the sweep generator and the variable aperture are sized such that the light detector is gated in picoseconds.

5. A gated light detector comprising:

a. photocathode for receiving a light signal and producing emission of electrons in proportion to the intensity of the light signal;

b. an accelerating mesh for accelerating the electrons emitted by the photocathode into a deflection field;

c. sweeping electronic means for sweeping the electrons in the deflection field over a defined angular distance at a defined rate;

d. electron multiplication means for receiving the electrons swept over at least a portion of the defined angular distance, performing electron multiplication thereon and producing an analog electric signal output corresponding to the intensity of the light incident on the photocathode over a time window corresponding to the time during which the electrons are received by the electron multiplication means;

e. said time window being dependent on the sweep rate of the sweeping electronic means and the size of the electron multiplication means relative to the defined angular distance; and f. a variable aperture disposed behind and separate from said sweeping electronic means and in front of said electron multiplication means for limiting the angular distance over which electrons swept by the sweeping electronic means are received by the electron multiplication means so as to further reduce the time window.

6. The gated light detector of claim 5 and wherein the sweeping electronic means comprises a pair of sweeping electrodes and a sweep generator, said sweep generator being activated by a trigger signal.

7. The gated light detector of claim 6 and wherein the electron multiplication means comprises a dynode chain, the dynode chain comprising a first dynode, a plurality of intermediate dynodes and a last dynode, the size of the first dynode defining the portion of the defined angular distance over which the swept electrons are received by said dynode chain.

8. The gated light detector of claim 7 and further including a first microchannel plate for performing electron multiplication of electrons swept by the sweeping electrodes.

9. A gated light detector comprising:

a. a photocathode for receiving a light signal and producing emission of electrons in proportion to the intensity of the light signal;

b. an accelerating mesh for accelerating the electrons emitted by the photocathode into a deflection field;

c. sweeping electronic means for sweeping the electrons in the deflection field over a defined angular distance at a defined rate;

d. electron multiplication means for receiving the electrons swept over at least a portion of the defined angular distance, performing electron multiplication thereon and producing an analog electric signal output corresponding to the intensity of the light incident on the photocathode over a time window corresponding to the time during which the electrons are received by the electron multiplication means;

e. said time window being dependent on the sweep rate of the sweeping electronic means and the size of the electron multiplication means relative to the defined angular distance;

f. a variable aperture disposed behind and separate from said sweeping electronic means and in front of said electron multiplication means for limiting the angular distance over which electrons swept by the sweeping electronic means are received by the electron multiplication means so as to further reduce the time window;

g. said sweeping electronic means comprising a pair of sweeping electrodes and a sweep generator, said sweep generator being activated by a trigger signal;

h. said electron multiplication means comprising a dynode chain including a first dynode a plurality of intermediate dynodes and a last dynode the size of the first dynode defining the portion of the defined angular distance over which the swept electrons are received by said dynode chain; and i. a first microchannel plate disposed between the sweeping electrodes and the varible aperture for performing electron multiplication of electrons swept by the sweeping electrodes.

10. The gated light detector of claim 9 and further including an input slit in front of the photocathode and relay optics for imaging the input slit onto the photocathode.

11. The gated light detector of claim 10 and further including a tubular housing for holding the photocathode, the accelerating mesh, the sweeping electrodes, the first microchannel plate, the variable aperture and the dynode chain.

12. The gated light detector of claim 11 and further including a delay unit for delaying the trigger signal to the sweep generator.

13. The gated light detector of claim 12 and further including means for varying the electron multiplication produced by the microchannel plate.

14. The gated light detector of claim 13 and wherein the sweep generator includes means for varying the sweep rate.

15. The gated light detector of claim 14 and wherein the sweep generator produces sweep rates as fast as 25 picoseconds per millimeter.

* * * * *